US005087183A

United States Patent [19]

Edwards

[11] Patent Number: 5,087,183

[45] Date of Patent: Feb. 11, 1992

[54] ROTARY VANE MACHINE WITH SIMPLIFIED ANTI-FRICTION POSITIVE BI-AXIAL VANE MOTION CONTROL

[76] Inventor: Thomas C. Edwards, 1426 Gleneagles Way, Rockledge, Fla. 32955

[21] Appl. No.: 534,542

[22] Filed: Jun. 7, 1990

[51] Int. Cl.[5] ..... F04C 2/344

[52] U.S. Cl. ..... 418/265; 418/260

[58] Field of Search ..... 418/265, 264, 260

[56] References Cited

U.S. PATENT DOCUMENTS

| | | | |
|---|---|---|---|
| 502,890 | 8/1893 | Reichhelm . | |
| 599,783 | 3/1898 | Funk . | |
| 949,431 | 2/1910 | Hokanson . | |
| 994,573 | 6/1911 | Cotoli . | |
| 1,042,596 | 10/1912 | Pearson . | |
| 1,291,618 | 1/1919 | Olson | 418/265 |
| 1,336,843 | 4/1920 | Kutchka . | |
| 1,339,723 | 5/1920 | Smith . | |
| 1,549,515 | 8/1925 | Smith . | |
| 1,669,779 | 5/1928 | Reavell | 418/265 |
| 1,883,275 | 11/1931 | Burmeister . | |
| 2,003,615 | 6/1935 | Smith et al. | 418/265 |
| 2,179,401 | 11/1939 | Chkliar . | |
| 2,345,561 | 4/1944 | Allen, Jr. . | |
| 2,443,994 | 6/1948 | Scognamillo | 418/265 |
| 2,465,887 | 3/1949 | Larsh | 418/265 |
| 2,469,510 | 5/1949 | Martinmaas | 418/265 |
| 2,672,282 | 3/1954 | Novas | 418/265 |
| 2,781,729 | 2/1957 | Johnson et al. . | |
| 3,053,438 | 9/1962 | Meyer . | |
| 3,101,076 | 8/1963 | Stephens-Castaneda | 418/265 |
| 3,464,395 | 9/1969 | Kelly . | |
| 3,568,645 | 3/1971 | Grimm . | |
| 3,904,327 | 9/1975 | Edwards et al. . | |
| 3,952,709 | 4/1976 | Riddel . | |
| 4,005,951 | 2/1977 | Swinkels . | |
| 4,184,821 | 1/1980 | Smolinski et al. . | |
| 4,212,603 | 7/1980 | Smolinski . | |
| 4,247,268 | 1/1981 | Banolas de Ayala . | |
| 4,299,097 | 11/1981 | Shenk et al. . | |
| 4,410,305 | 10/1983 | Shemka et al. . | |
| 4,705,465 | 11/1987 | Su . | |
| 4,958,995 | 9/1990 | Sakamaki et al. | 418/265 |

FOREIGN PATENT DOCUMENTS

| | | | |
|---|---|---|---|
| 874067 | 5/1943 | France | 418/265 |

*Primary Examiner*—Richard A. Bertsch
*Assistant Examiner*—David L. Cavanaugh
*Attorney, Agent, or Firm*—Evenson, Wands, Edwards, Lenahan & McKeown

[57] ABSTRACT

A fluid displacement machine of the vane type utilizing a cylindrical rotor equipped with one or more tethered sliding vanes wherein the rotor and vane set is rotatably located eccentrically inside an internal conforming casing profile between opposing endplates which combination thereof defines enclosed variable volume compartments. Each vane is fitted on opposite sides with tethers which are pivotally-mounted remotely from the vane tips. The tethers engage, through anti-friction means, circular annuli located within the endplates which are concentric with the hollow casing profile. Two anti-friction tether-to-annuli means are revealed, one in the form of freely-rotating caged roller bearings interposed between the tethers and the respective internal annuli, and the other in the form of tethers equipped with trunnioned bearings which directly engage these internal annular surfaces. Combinations of these anti-friction vane tethering means are also revealed. The vane tethers engage both internal peripheries of the endplate annuli for the purpose of providing positive bi-axial radial vane motion control, and the profile of the casing is defined such that the tips of the positive motion-controlled vanes remain in an exceedingly close yet substantially frictionless sealing relationship with the conforming hollow casing.

26 Claims, 5 Drawing Sheets

FIG 4c
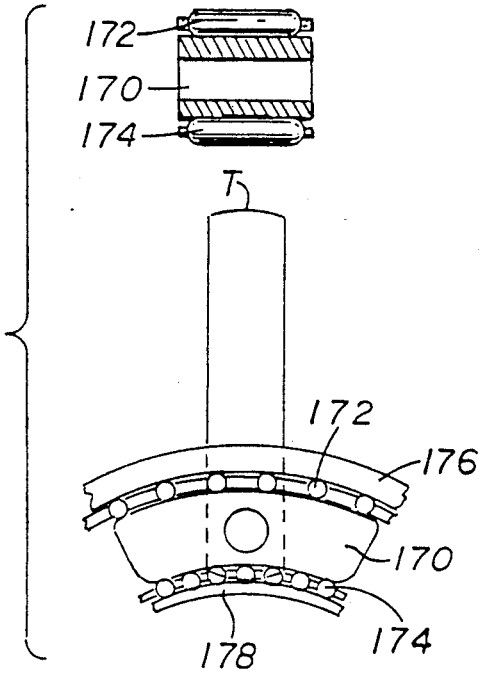
FIG 4d
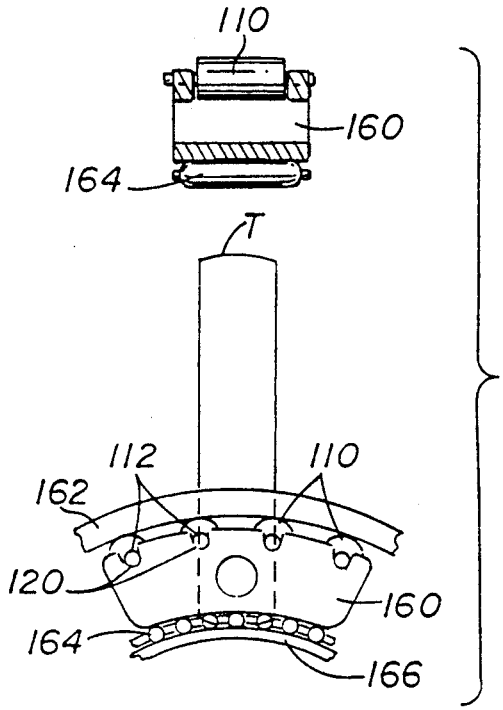
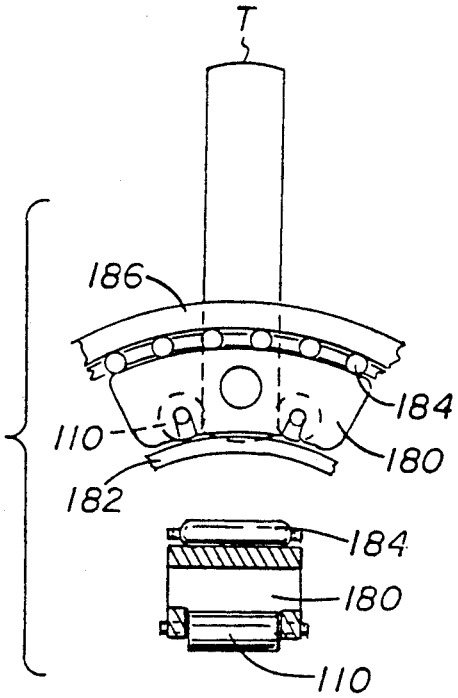
FIG 4e
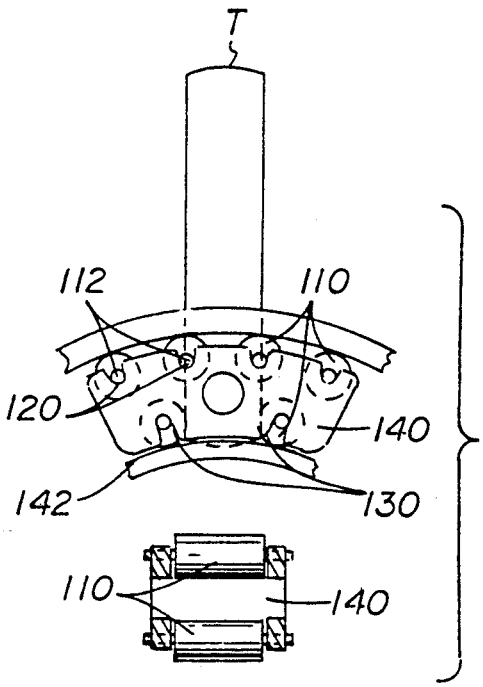
FIG 4f

ROTARY VANE MACHINE WITH SIMPLIFIED ANTI-FRICTION POSITIVE BI-AXIAL VANE MOTION CONTROL

FIELD OF INVENTION

This invention is related to guided rotary sliding vane machinery in which the radial motion of the vanes is controlled to obtain non-contact sealing between the vane tips and the interior stator casing sidewall as a result of the cooperation of opposing vane extensions that engage cooperative circular radial guides that are located on both ends of the machine.

BACKGROUND OF INVENTION

Conventional and elementary sliding rotary vane machines are distinguished from virtually all other fluid displacement machines in their remarkable simplicity. On the other hand, such machines exhibit relatively poor operating efficiency. This poor energy efficiency is rooted directly in machine friction, both mechanical and gas dynamic. As is well known, the predominant source of mechanical friction in conventional production non-guided vane rotary machines occurs at the intense rubbing inter-face of the tip of the sliding vane and inner contour of the stator wall. Furthermore, governing the motion of the vane by the stator wall contour necessarily and greatly inhibits the area through which gas can enter or exit the machine. This results in increased fluid flow pressure losses in the inlet and outlet port regions of such type machines.

Over the years, many means have been proposed to eliminate guiding the radial motion of the vanes through the direct action of the vane tips rubbing along the inside casing or stator wall. In a majority of previous endeavors to grapple with this mechanical problem, attention has been focused upon the use of wheels or rollers pinned to the sides of the vanes wherein these rollers follow inside a circular or non-circular track of the appropriate configuration. The cooperation of the rollers in the roller guide track then produces a means of dictating the radial location of the vane which is pinned to the roller follower and hence determines the position of the tip of the vane.

As attractive as this approach first appears to be, roller wheels contain an overwhelming flaw: They cannot provide positive bi-axial radial motion without having to reverse their rotational direction. That is, vanes constrained by rollers can accommodate geometric displacement in only an outward or inward direction at any one time.

As an example, if the roller has been in contact with one side of the track, and because of this, it has been turning in the clockwise direction, and then should the roller be caused to come in operative contact with the other side of the guide, the roller will be turning in what may be regarded as the wrong direction. As a consequence, each roller undergoes skidding inside the track until they are stopped. Then each vane roller must reverse rotational direction and accelerate to the speed which will match the motion dictated by the other side of the roller guide. Because, in practice, vane machines generally require both positive inward and outward vane motion, rollers become impractical or non-functional in real machines where both motions are often demanded.

Other innovators have taught the use of sliding arc segment tethers in place of vane rollers. In such prior art instances, the arc segment tethers are captured within a circular annular groove that may or may not be rotatable. The arc segment vane tether has the outstanding and fundamentally important advantage of being able to deliver both positive inward and outward radial motion to the vane simultaneously. However, in the prior art, vane motion control techniques used arc segment vane tethers which entailed considerable mechanical friction that arises from the sliding of the arc tether surfaces against the circular annular guides, whether or not the guides themselves are rotatable.

Further, and of fundamental importance, previous workers have failed to provide teachings of the specific contour that the internal casing profile must take on in order for the vane tips to mate closely in a non-contact but sealing relationship with this casing contour profile. Earlier innovators have either simply erred and believed that the proper casing contour was "circular", or circumvented the fundamental issue by characterizing the shape of the internal casing contour with words such as "substantially circular" and not teach operatively just how this shape is determined.

As will be seen in considerable detail hereinafter, the present invention not only eliminates the majority of the mechanical sliding friction endemic to previous techniques, but it does so with fewer and simpler components than were required by the prior art. At the same time, this invention accomplishes the fundamentally important positive bi-axial radial vane motion control necessary for the practical operation of such machines. Finally, my invention accommodates the natural motion of the tips of circularly-tethered vanes by providing exceedingly close non-contact vane tip sealing as a result of properly shaping the mating or conjugate interior of the casing wall.

SUMMARY OF THE INVENTION

The embodiments shown and described herein are ideally suited for use as an automotive air conditioning compressor, although my invention may be used in many other fashions and relationships. A major aspect of my present invention is comprised of two principal embodiments, both of which center upon simple, anti-friction, easily-producible, economical, and motion-positive means for insuring the accurate transfer of radial movement from the circular radial vane guide to the vane. The cooperation of either of these means of precise anti-friction vane motion control with a special internal casing profile, which I prefer to call a conjugate casing contour, results in maintaining an excellent sealing but non-contact, and thus, minimum friction relationship between the tips of the vanes and the internal conjugate stator contour. Such a condition yields a simple vane type fluid handling device of high volumetric and energy efficiency.

The first of these principal vane motion control embodiments involves the use of plain arc segment vane tethers that are pinned pivotally to the vanes and that ride directly upon freely-rotating retained roller bearings that roll inside the internal surface of circular, non-rotating radial vane endplate guides. The second of these principal techniques involves vane tether elements resembling roller skates, also pivotally-pinned to the vanes, that ride on non-rotating circular vane guides located in the endplates of the device.

As will become more apparent as this description proceeds, the two principal anti-friction vane motion control embodiments revealed here are combinable to yield yet additional embodiments which can be used quite effectively, depending upon the purpose to be served.

It is therefore the primary object of my invention to provide a vane type fluid displacement machine that accomplishes non-contact vane tip sealing in a particularly simple and energy efficient manner and which is relatively easy to manufacture and to maintain in service.

It is another important object of my invention is to provide a non-contact rotary vane machine that is extremely reliable, and which can operate with a wide variety of refrigerants, including those not harmful to the earth's stratospheric ozone layers.

It is still another object of my invention to provide a non-contact vane type compressor that can operate over a large range of operational speeds and still maintain high operating efficiency.

It is yet still another object of my invention to provide a non-contact vane type compressor whose vane tips are positioned by the utilization of circular radial vane guides, eliminating the use of the costly non-circular vane guides extensively utilized by the prior art.

These and other objects, features, and advantages will become more apparent as the description proceeds.

BRIEF DESCRIPTION OF FIGURES

FIG. 4*c* illustrates an embodiment using freely-rotating retained bearings operating on both the inner and outer peripheries of a plain arc segment vane tether;

FIG. 4*d* shows an arc segment vane tether equipped with trunnion rollers in the outside arc region which interface with a freely-rotating retained roller bearing disposed on the inner periphery of the annular surface of the radial vane guide;

FIG. 4*e* shows the combination of a caged freely-rotating retained roller bearing on the outside periphery of the arc segment vane tether, but revealing that the vane tether is equipped with trunnioned rollers on its inner periphery;

FIG. 4*f* portrays a vane tether equipped with trunnioned rollers on both its inner and outer peripheries;

FIG. 5 shows details of the stator contour geometry required for functional operation of the invention as a gas compressor or the like.

DETAILED DESCRIPTION

Figure 1:
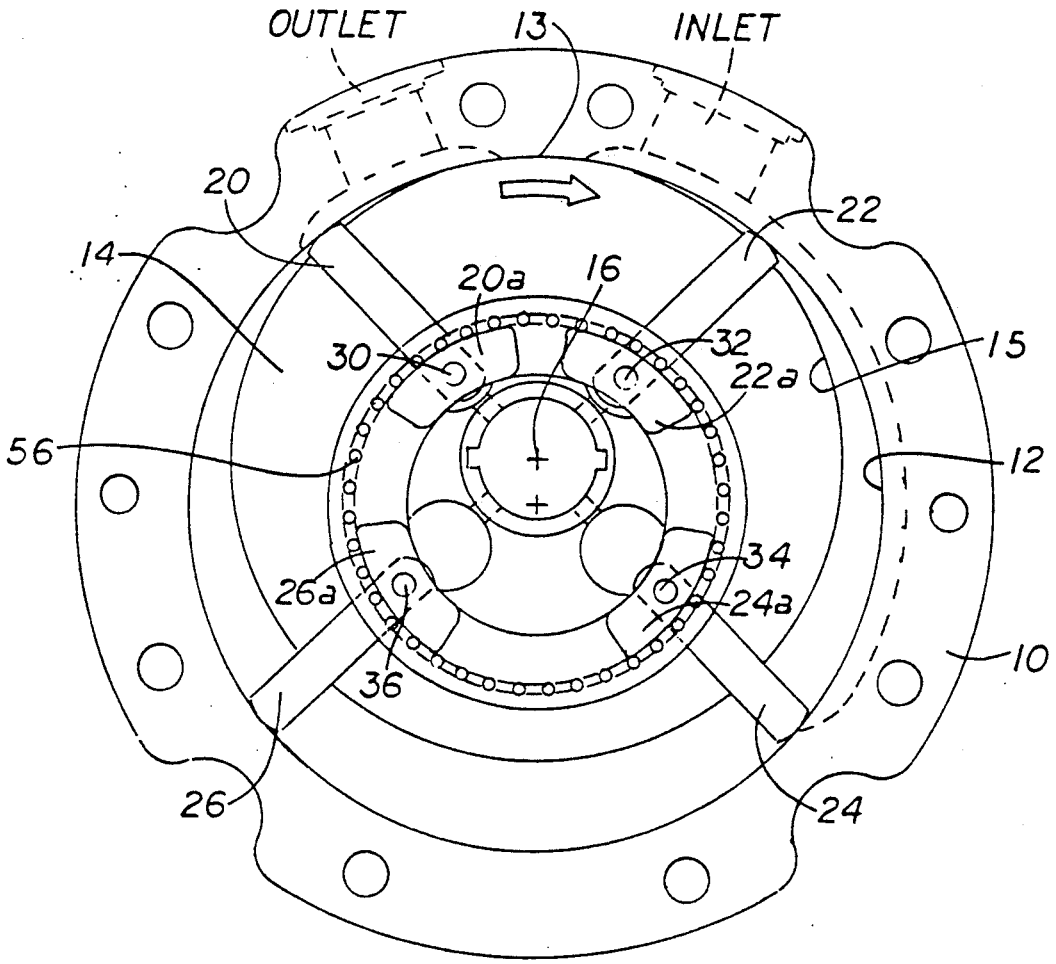
FIG. 1 presents an elevation view of my invention, with one endplate removed so as to reveal the rotor equipped with the tethered sliding vanes and an accompanying annular vane guide.

In order to understand further the function and operation of the non-contact vane-type fluid displacement machine in accordance with a first embodiment of this invention, reference is first made to FIG. 1 which illustrates many of the principal elements of my invention. These elements include the casing which is equipped with an internal profile contoured specifically to tangentially mate in a sealing but non-contact relationship with the actual controlled motion of the tips of the vanes as they are carried within the rotor. This cooperation thus maintains a sealing but non-contact relationship there between. I prefer to refer to this internal conforming profile as a conjugate or conformal profile, and the precise technique by which this conjugate profile is determined is explained in detail hereinafter.

With continuing reference to FIG. 1 it will be noted that rotor 14 is disposed in an eccentric relationship to the internal conforming profile 12 of the casing 10, with center point 16 denoting the axis about which rotor 14 rotates. Although I am not to be limited to any particular number of vanes to be carried by the rotor 14, for purposes of illustration I have shown in FIG. 1 vanes 20, 22, 24 and 26 which, for all intents and purposes, can be regarded as being identical to each other. Further, it can be seen that these vanes are equipped with what I prefer to call vane tethering means, these being denoted as 20*a*, 22*a*, 24*a* and 26*a*, respectively. These vane tethers can themselves also be considered, for all intents and purposes, identical to each other and to cooperate with the vanes through means such as pins 30, 32, 34, and 36. The vanes 20, 22, 24, and 26 may be seen clearer and in more detail in FIG. 3.

As will be understood by those skilled in this art, fluid to be compressed is admitted through the port denoted INLET in FIG. 1, and the compressed fluid is delivered out of the port captioned OUTLET.

Figure 1A:
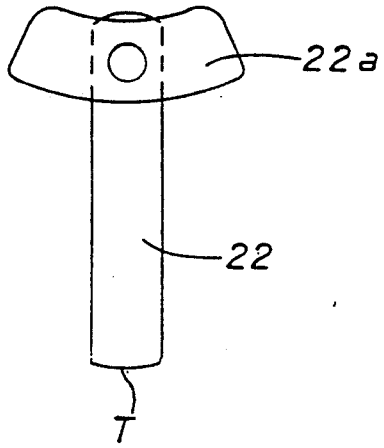
FIG. 1*a* illustrates a break-out of one of these tether/-vane assemblies.

In FIG. 1*a* I have shown details of a typical vane and its corresponding tether. As noted, this vane is captioned as vane 22, and its tether 22*a*, and is further equipped with a carefully located circular arc vane tip, indicated in this Figure as T. In accordance with this invention, the vane tip T is intended to travel immediately within the tangentially conforming inner wall 12 of the stator 10 in an exceedingly close yet substantially frictionless non-contacting relationship.

Figure 2:
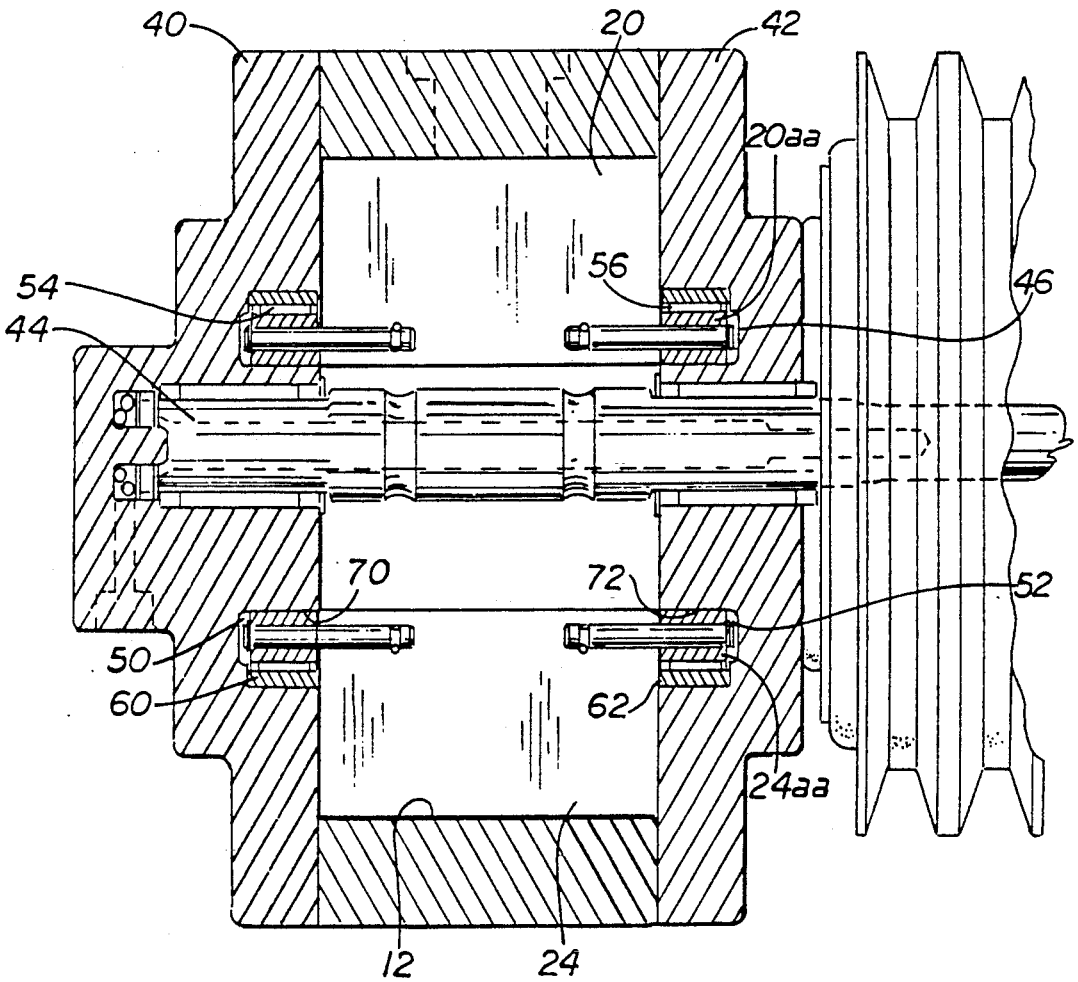
FIG. 2 is a side elevation of a primary embodiment of my invention, offering a cross-sectional view of certain vanes with their tethers in the tether annuli in opposing endplates.
Figure 2A:
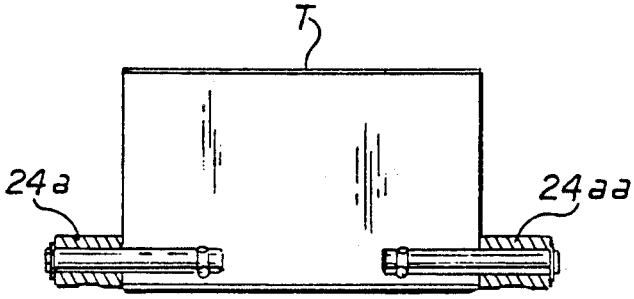
FIG. 2*a* illustrates a break-out of the sideview of a typical vane/tether assembly.

A means in accordance with this invention by which precision vane motion can be accomplished with a minimum of mechanical friction can be seen by referring to FIGS. 1, 1*a*, 2 and 2*a*. It is to be understood that vane tethers 20*a*, 22*a*, 24*a*, and 26*a* have identical companions utilized on the opposing side of each of the respective vanes through the action of corresponding tether pins, and it is therefore sufficient to describe only a single set of tethers associated with each vane. Visible in FIG. 2*a* are tethers 24*a* and 24*aa* of vane 24 with tip T. These and the other sets of vane tethers, operating in conjunction with certain endplate annuli and anti-friction means to be described in more detail hereinafter, are responsible for each vane tip T moving in the aforementioned desired exceedingly close yet substantially frictionless relationship to the inner conjugate profile 12 of the casing 10.

Referring now specifically to FIG. 2, it will there be noted that the casing 10 is revealed to be bounded on its left and right sides by the endplates 40 and 42 which, for the purposes of this explanation, are substantially identical except that the rotor shaft 44 protrudes through the right endplate. These endplates are secured to the casing 10 by any conventional means, such as through-bolts, and such details are of no particular concern to this invention.

As is clear to those skilled in this art, volumetric changes can be brought about with rotor rotation because of the eccentric relationship between the axis of the rotor 14 with its attending set of vanes 20 through 26, the supporting opposing endplates, and the internal con-forming profile 12 of the casing. This is, of course, brought about in such a way that pumping or compression of fluids entering through the INLET can be accomplished and discharged through the OUTLET, as was previously mentioned. However, for compression and/or pumping to be accomplished efficiently, the periphery 15 of rotor 14 must sealingly engage the internal casing profile in region 13.

It can be further noted from FIG. 2 that rotor 12, which is rotatably supported in the endplates 40 and 42 by the use of the shaft 44, may be considered either to be integral with the shaft, or to be engaged with the shaft in a close axial sliding fit, having a zero relative rotation. Suitable bearings are utilized in the endplates in order that the rotor shaft 44 and rotor 14 can freely rotate, and it is to be understood that the left and right faces of the rotor 14 are operatively disposed in a contiguous sealing relationship with the inner walls of the endplates. Suitable lubrication is provided at this interface and in other locations within the machine, in accordance with well-known techniques.

It can be noted in FIG. 2 that I have opened portions of the drawing in order to reveal the presence in each illustrated endplate of the earlier-mentioned circular annuli, with annulus 50 being located in endplate 40, and annulus 52 being located in endplate 42. It can also be noted that the center of these annuli are coincident with the geometric center of interior casing of the conforming profile 12. It is quite important to observe that because these annuli are circular rather than non-circular, manufacturing costs are minimized by this aspect of my technique. Further savings in manufacturing costs and increases in machine performance can be derived from employing annuli which can be produced separately from the endplate itself and then joined with the endplate during assembly as shown in FIG. 1.

In order to facilitate the utilization of one friction minimizing means in the annuli, I prefer, as indicated above, to dispose a hardened steel ring 60 in annulus 50, and a substantially identical hardened steel ring 62 in annulus 52. It is in annular ring 60 that the tethers 20*a*, 22*a*, 24*a* and 26*a* travel as seen in FIG. 1, whereas their companion vane tethers travel in annular ring 62 shown in FIG. 2 as the rotor 14 rotates in the casing 10.

Although my invention would be operative without friction minimizing means utilized with the conjugate internal casing profile 12, I find it greatly preferable to utilize a freely-rotating caged roller bearing inside each of the hardened steel rings, with FIG. 2 revealing that bearing 54 is utilized in ring 60 located in annulus 50, whereas bearing 56 is utilized in annulus 52.

Continuing with FIG. 2, it will be seen by the utilization of this centrally-disposed cross-sectional view, that I have exhibited that the roller bearings 54 and 56 are arranged to ride inside the hardened steel rings 60 and 62, respectively, in order to provide a minimal friction guide means for tethers 20*a*, 22*a*, 24*a* and 26*a*. These tethers are, of course, respectively associated with the aforementioned vanes 20, 22, 24, and 26, with a like condition occurring on the opposite side of the machine.

Because of the advantageous techniques I utilize, the tethers, in traveling inside the caged roller bearings disposed in the interior of the respective annuli, will not only experience minimal friction directly, but will also guide vane tips T in a minimal friction relationship with the internal conjugate sidewall 12. Thus, this embodiment of my invention elegantly achieves the paramount goal of yielding a substantially frictionless yet highly effective sealing relationship between the tips T of the vanes and the corresponding conjugate interior surface 12 of casing 10 that can be easily manufactured. The specific means by which the interior surface 12 is developed in accordance with the teachings of this invention will be set forth in detail hereinafter.

At this juncture, however, it is advantageous to realize that the foregoing description can be interpreted in such a fashion as to consider the rings 60 and 62 as behaving as the outer races of conventional roller bearings but with the inner races actually consisting of a plurality of independent circular segments which happen to be pinned to the vanes and thus behave as vane tethers. The caged roller bearings 54 and 56 therefore function in much the same fashion as conventional caged bearing assemblies. Certain of the rollers or roller bearings of the additional tether embodiments in accordance with this invention will be understood to experience both sliding and rolling, much as do the rollers in both full-compliment and retained or caged roller bearings.

As emphasized hereinbefore, an important and basic objective of this invention is to insure positive radially inward vane motion control as well as positive outward vane motion control. This fundamentally important machine function is provided elegantly as shown in FIG. 2 by the plain outer diametral surfaces 70 and 72, each being respectively the inner peripheral surfaces of annuli 50 and 52, themselves respective of endplates 40 and 42. The circular peripheral surfaces 70 and 72 serve, through their cooperation with the inner peripheries of the vane tethers, to positively limit the inward radial travel of the vanes. Thus, the combined action of the outward-motion-limiting freely-rotating bearings 54 and 56, operating in conjuction with respective hardened steel rings 60 and 62 with the inner peripheries of inner annular surfaces 70 and 72, serve to positively define the radial motion of the vane tethers moving therebetween. Thus it is to be seen that this arrangement uniquely defines the path of travel of the vane tips, with vane tip T of vane 22 being shown, for example, in FIG. 1*a*.

Figure 3:
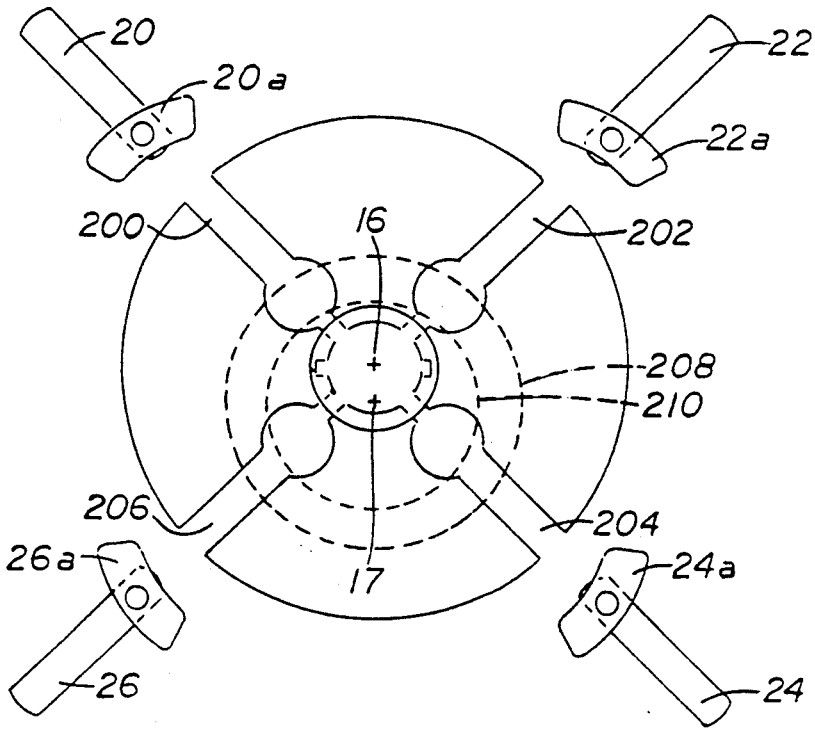
FIG. 3 shows a face view of the rotor with a corresponding set of tethered vane assemblies depicted in exploded relationship out of their respective rotor slots. This figure also reveals in broken lines the annular surfaces located in the endplates that serve to guide the vane tethers.

FIG. 3 is presented to further elucidate the relationships arising among the rotor 14, the rotor slots 200, 202, 204, and 206 and their corresponding vanes 20, 22, 24, and 26 which are shown radially separated from their actual locations within the rotor slots. The radially outwardly disposed governing surface 208 and the radially inwardly governing surface 210 of the annular vane tether guide are shown in broken lines in FIG. 3 in their proper relationship to the rotor center 16. Point 17 is the coincident center of both the circular annulus and the internal stator casing profile 12. It is these surfaces which enclose the vane tether and the anti-friction bearing means interposed therebetween, and thus dictate the circular anti-friction path of the vane tethers.

Figure 4A:
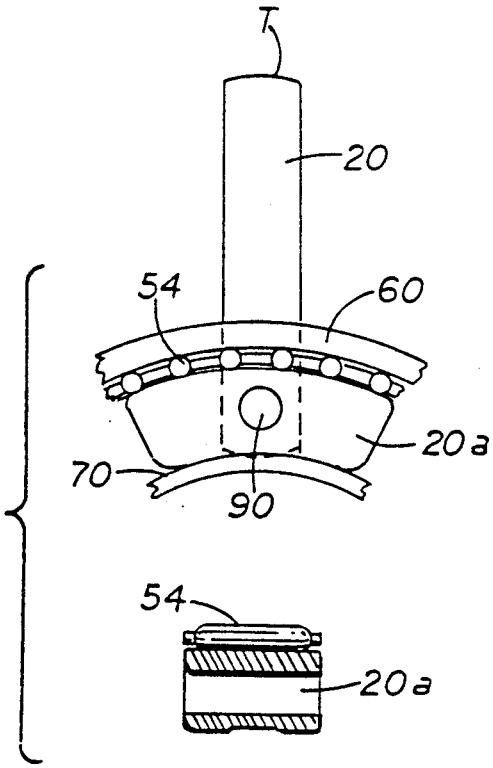
FIG. 4*a* presents enlarged details of the construction of one of the embodiments of this invention that utilizes a freely-rotating caged bearing friction minimizing means, with plain positive outward radial motion control.

Attention should now be given to FIG. 4*a* which presents yet additional detail regarding the anti-friction radial vane guide embodiment discussed in the foregoing. Note especially that this drawing illustrates the construction and cooperation among the outer radial vane guide race 60, the freely-rotating caged bearing 54, and, for example, tether 20*a*, and the inner peripheral annular surface 70. The face end of vane tether pin 90 is shown here that pivotally connects vane tether 20*a* with vane 20.

It is to be understood in FIG. 4*a* that a slight clearance exists, in accordance with embodiments revealed herein, between the underside peripheral surface of the arc segment vane tethers and the circular peripheral surfaces 70 and 72 of annuli 50 and 52. This clearance is important for two reasons.

One reason is because contact with these internal annular surfaces is ordinarily not needed or wanted because the radially positive centripetal forces on the vane assembly during machine operation are usually sufficient to maintain positive outward radial vane motion. Another reason, which is more subtle, arises when my invention is used as a vapor compressor in an air conditioning system. At start-up or during off-design operating conditions, it is not uncommon for a certain amount of liquid refrigerant to occassionally enter the INLET (shown in FIG. 1*a*) of the machine. This occurrence is known as liquid "slugging."

If no inward radial slack is available to the vane, extreme pressures can sometimes arise within the compression region of the device and potentially cause significant damage to the device. Thus, the interface clearance between the inner annular surfaces 70 and 72 and the underside peripheries of the vane tethers also provide, in the case outlined here, a built-in "safety valve." The amount of clearance required to prevent damage from liquid slugging is relatively slight, being only on the order of 0.02 to 0.2 mm and therefore functions in harmony with the embodiments herein described.

Figure 4B:
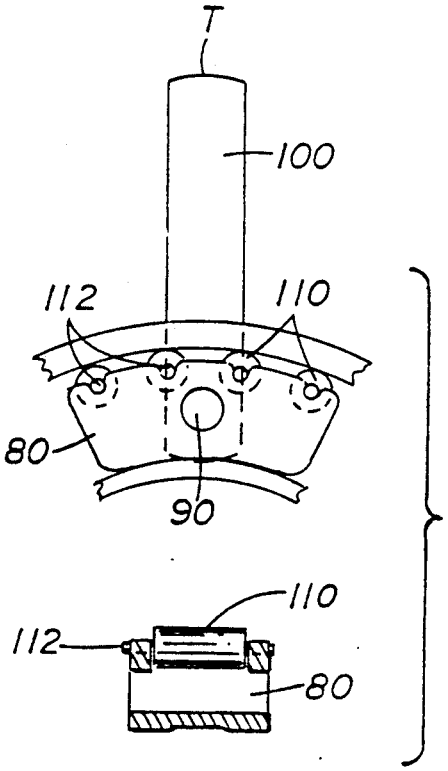
FIG. 4*b* presents details of the construction of another embodiment of a tether in which the tether features trunnioned rollers and plain positive outward radial motion control.

Attention is now directed to FIG. 4*b*, where the second and preferred basic vane tether assembly is presented. In the case of the vane tether depicted here, the vane tether frame 80, which is attached to vane 100 via tether pin 90, is fitted with trunnioned rollers 110. The trunnions 112 of trunnioned roller 110 ride within the circular bottom bearing slots 120 of the vane tether frame 80. In this arrangement, the freely-rotating retained needle bearing assembly shown previously is eliminated and effectively replaced by the trunnioned rollers residing within the vane tether frame 80.

FIG. 4*c* portrays yet another combination biaxial radial vane motion control embodiment. In this case, the peripheries of vane tether 170 are plain on both the inner and outer surfaces. Both of these outside peripheral tether surfaces then ride between the outer and larger freely-rotating retained roller bearing assembly 172 and the inner and smaller freely-rotating bearing assembly 174. The outer caged freely-rotating bearing 172 thus rides inside bearing race 176 and the inner caged freely-rotating bearing 174 rides over the inner bearing race 178. Such an arrangement as portrayed here also insures positive anti-friction control of both inward and outward radial motion of the vane/vane tether assemblies.

FIG. 4*d* shows still another positive bi-axial anti-friction radial vane motion control arrangement. In this combination of elements, the outer periphery of the arc segment vane tether frame 160 is again equipped with rollers 110 whose trunnions 112 engage trunnion slots 120. Again, these trunnioned rollers 110 ride rollingly inside outer bearing race 162. The inner periphery of this tether segment 160 then engages the inner freely-rotating retained roller bearing 164 which, in turn, rides upon the inner annular bearing race 166.

Shown in FIG. 4*e* is yet another combination positive bi-axial radial vane tether motion control system. In this embodiment, the vane tether frame 180 is equipped with trunnioned rollers 110 on its inner periphery. These inner trunnioned rollers then roll over the outer annular peripheral surface 182. However, as seen in the previous embodiments, the outer peripheral surface of tether frame 180 rides upon the freely-rotating retained roller bearing assembly 184 which, again in turn, rides upon outer annular race 186. Once more, an embodiment is shown that provides positive bi-axial anti-friction radial vane motion.

FIG. 4*f* shows still another double-acting or bi-axial anti-friction vane tether frame embodiment. In this case, frame 140 is equipped with trunnioned rollers 110 whose trunnions 112 engage outer peripheral trunnion slots 120 and inner trunnion slots 130. Such an arrangement can also be used when positive bi-axial motion is preferred using anti-friction means. In such a case as shown here, the inner trunnioned rollers 110 ride upon the inner peripheral surface of bearing ring race 142. Such particular means is well equipped to handle especially heavy inward radial loads.

As emphasized throughout the foregoing, the geometric shape of the inner wall 12 of the stator casing 10 shown in FIG. 1 is critical to the efficient function of my invention. Appreciation for this governing fact can be seen in FIG. 5. Shown here is a magnified view of the special conjugate or mating internal casing profile that is demanded of this invention. In this Figure, the variance of the contour 12 from a pure circle becomes quite apparent. It can be seen that the vane tip T actually recedes significantly inside the path of a true circular contour as the vanes rotate and reciprocate with the rotor.

The reason for this geometric effect is due to the fact that, although the vane tether pin follows a true circle, the necessary rotor-to-stator eccentricity (offset) causes the vanes to tilt at a constantly-varying but cyclic angle with respect to the slope of the inner stator contour. Further, the point or line of tangency at the vane tip T to internal conjugate casing profile 12 continuously changes location with the motion of the vanes. The complex and subtle vane motion thus describes a contour that resembles a circle that is compressed about its equator.

Figure 5:
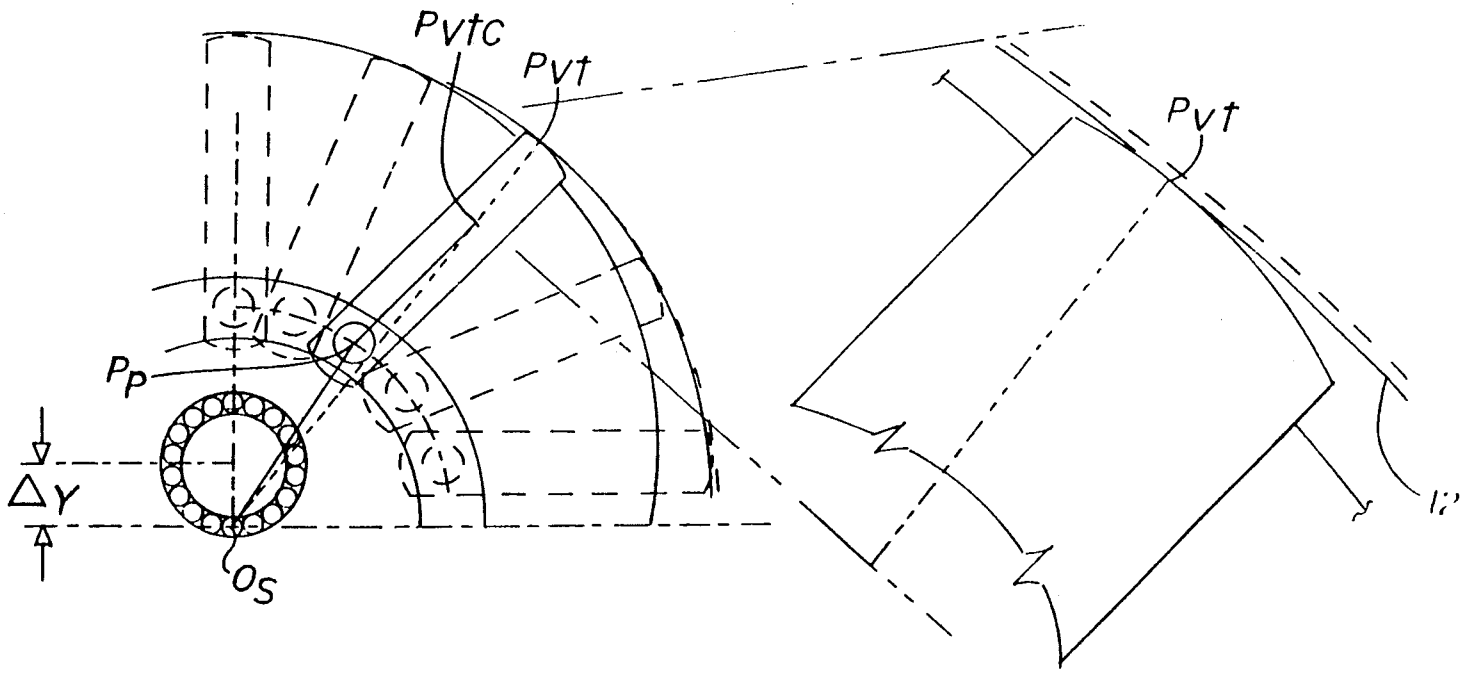

Recall that a fundamental assignment of machines such as disclosed here is to efficiently compress gases or pump liquids. This can be achieved only if the distance between the line of tangency of curved vane tip T and the inner stator contour 12 of casing 10 is very small; on the order of only a few hundredths of a millimeter. Thus, my invention can function at high efficiency only if contour 12 takes on this very special and non-circular shape. If a true circular stator contour was used, and as can be seen in FIG. 5, large leakage gaps develop between the vane tip and stator housing wall. The development of such leakage gaps using a true circular stator interior is many times larger than would be acceptable for efficient performance. Therefore, very close attention must be brought to bear in determining the unique shape of the interior stator wall.

With continuing reference to FIG. 5, the required geometrical condition can be seen for the vane tip to remain tangent to the inner stator contour 12 at all angular locations of the rotor/vane assembly. I have found that the precise point of tangency of the vane tip with contour 12 can be determined by constructing a line from the geometric center Os of the vane guide ring (which is also the geometric center of the conjugate internal casing contour 12) to the center of the radius of the vane tip, Pvtc.

If this special line is extended to intersect the radial contour of the vane tip, this point of intersection (shown in FIG. 5 as Pvt) is exactly the location of the corresponding point required to define the conjugate casing interior contour 12. I have used this insight in the creation of the required conjugate stator profile employed in accordance with this invention, the details of which are now presented.

Knowing now the precise geometrical condition required to accurately define the conjugate internal casing contour 12, algebraic and trigonometric relationships can be applied to compute the entire locus of points that define this special contour. A direct computation algorithm for the required internal casing contour can be capsulized as follows in connection with FIG. 5:

A. Set initial extended angular location of the vane.

B. Locate the coordinates of the vane pivot pin, Pp, from a knowledge of the vane angle and the radius of the circular radial vane guide.

C. Compute the corresponding angle from the horizontal axis of the stator to the line from the stator center, Os, and the vane tip radius center Pvtc, from a knowledge of the dimensions of the vanes and trigonometric functions.

D. Locate the coordinates of the vane tip radius center from the angle found in C above and the lineal dimensions of the vane.

E. Finally, locate the coordinates of tangency point Pvt from a knowledge of the vane tip radius and the angle to the center of this vane tip radius from the stator center.

F. Repeat the calculations as needed by incrementing the angular location of the vane to generate the entire locus of points of the required internal conjugate casing contour.

The specific mathematical relationships which code the foregoing are next presented, also in reference to FIG. 5:

I. Definition of Initial Nomenclature

Rg=Radius of annular vane tether guide
Rr=Radius of rotor
Rs=Vertical semi-minor axis of internal stator profile
Rt=Distance from tether pin center to center of vane tip radius
rt=radius of vane
e=Rs-Rg; Rotor eccentricity
Ar=Rotor/vane input angle as measured from the horizontal and repeatedly incrementable to generate locus of conjugate stator profile points II. Algebraic and Trigonometric Relationships 1. Cartesian coordinates of vane tether pin centers as measured from the coincident center Os of the conjugate stator profile and the annular vane tether guides $$xg=Rg[\cos(Ar)]$$

$$yg=Rg[\sin(Ar)]$$

where cos and sin each represent the trigonometric cosine and sine functions, respectively;

2. Angle Ag of line from rotor center through vane tether pin center Pp and through vane tip radius center Pvtc as measured from the horizontal rotor axis $$Ag=\text{atan}\,[yg/xg]$$

where atan signifies the trigonometric arc tangent function;

3. Radius Rp from rotor center to tether pin center $$Rp=\text{sqrt}\,[xg\hat{}2+yg\hat{}2]$$

where sqrt signifies the mathematical square root and ^2 signifies the mathematical square;

4. Radius Rtc from rotor center to center of vane tip radius $$Rtc=Rp+Rt$$

5. Cartesian coordinates of vane tip radius center as measured from the stator profile center $$xtc=Rtc\,[\cos(Ar)]$$

$$ytc=Rtc\,[\sin(Ar)]+e$$

6. Angle At from stator center to vane tip radius center as measured from the stator horizontal axis $$At=\text{atan}\,[ytc/xtc]$$

7. Radius Rtc from stator profile center to center of vane tip radius $$Rtc=\text{sqrt}\,[xtc\hat{}2+ytc\hat{}2]$$

8. Extended radial distance Rtt from the stator center to the corresponding point of tangency Pvt between the vane tip and the conjugate internal stator contour $$Rtt=Rtc+rt$$

Line Rtt, which is the key geometrical conjugate relationship, is represented by the phantom line shown in FIG. 5;

9. Cartesian Coordinates of vane tip/stator wall tangency point Pvt $$xtt=Rtt\,[\cos(At)]$$

$$ytt=Rtt\,[\sin(At)]$$

The combination of angle At, found in 6 and the extended tangency radius Rtt, found in 8 defines the polar coordinates of the required conjugate stator profile 12 while the Cartesian coordinates of this same conjugate stator contour are found in 9 as the rotor/vane angle Ar is incremented over 360 angular degrees.

It is to be understood that the very small continuous gap between the vane tip and the conjugate profile in an actual machine is created either by shortening the vane tip in relation to the desired magnitude of this small interface gap or by adding this constant gap width to the conjugate contour itself. That is, in the first case, the actual distance, Rta, between the vane tether pin and the center of the vane tip radius, is Rt diminished by a small clearance, say 0.025 mm: Rta = Rt − 0.025 mm. Of course, the actual conjugate profile 12 is computed and manufactured on the basis of Rt.

In the second case, the distance Rt would remain physically the same, but the profile 12 would be computed and produced on the basis of Rtt increased by the small desired gap: Rtta = Rtt + 0.025 mm. Both methods can satisfactorily generate the sealing but non-contact condition between the vane tip and the conjugate stator profile required for efficient operation by this invention.

The present invention can be embodied in ways other than those specifically described here, which were presented by way of non-limitative example only. Variations and modifications can be made without departing from the scope and spirit of the invention herein described which are to be constructed and limited only by the following appended claims.

I claim:

1. A non-contact vane type displacement machine comprising a casing having around its interior a conjugate internal conforming profile, said casing being arranged between two opposing endplates, each endplate containing in its interior a circular annulus, said annuli being of substantially matching configuration, the center of each annulus being coincident with the geometric center of said conjugate internal confirming casing profile, a rotor supported by said endplates and mounted for rotation within said interior of said casing in a matching eccentric relationship with said conjugate internal conforming profile, said rotor having ends operationally disposed in a close fitting relationship with said opposing endplates, said rotor being equipped with at least one substantially radially disposed slot, a substantially rectangular vane being contained in each slot and having an accurately configured tip maintained in an exceedingly close but non-contact relationship with said conjugate internal conforming profile, each end of each vane being equipped with a pivotally-mounted tether at a location comparatively remote from said vane tip, each vane tether having inner and outer peripheries, anti-friction rollers operatively disposed at least one interface of each annulus and the respective vane tethers such that at least a portion of each of said tethers directly engages said anti-friction rollers, the annulus in each of said end-plates thus configured as an effective guide for said anti-friction rollers and the respective tethers of said vanes and, therefore, for the tips of said vanes, said vane tips thus being caused to remain in an exceedingly close yet substantially frictionless relationship with said conjugate internal conforming profile.

2. The non-contact vane-type fluid displacement machine as recited in claim 1 in which a single vane is utilized in said rotor.

3. The non-contact vane-type fluid displacement machine as recited in claim 1 in which a pair of vanes are utilized in said rotor, disposed in an opposite relationship with regard to the axis of rotation of said rotor.

4. The non-contact vane-type fluid displacement machine as recited in claim 1 in which at least three vanes are disposed within symmetrically placed slots about the axis of said rotor.

5. The non-contact vane-type fluid displacement machine as recited in claim 1, in which said anti-friction rollers are installed in each of said annuli.

6. The non-contact vane-type fluid displacement machine in accordance with claim 1, wherein the periphery of said rotor is engaged sealingly within the internal casing profile at a region separating the zone of high pressure fluid from the zone of low pressure fluid within said machine.

7. The non-contact vane-type fluid displacement machine as recited in claim 1, in which said anti-friction rollers are operatively installed on the outer periphery of each tether.

8. The non-contact vane-type fluid displacement machine as recited in claim 7, in which said anti-friction rollers are trunnioned bearings.

9. The non-contact vane-type fluid displacement machine as recited in claim 7, in which said anti-friction rollers are freely-rotating caged roller bearings.

10. The non-contact vane-type fluid displacement machine as recited in claim 1, in which said anti-friction rollers are operatively installed on the inner periphery of each tether.

11. The non-contact vane-type fluid displacement machine as recited in claim 10, in which said anti-friction rollers are trunnioned bearings.

12. The non-contact vane-type fluid displacement machine as recited in claim 10, in which said anti-friction rollers are freely-rotating caged roller bearings.

13. The non-contact vane-type fluid displacement machine as recited in claim 1, in which said anti-friction rollers operatively are installed on both the inner and the outer peripheries of each tether.

14. The non-contact vane-type fluid displacement machine as recited in claim 13, in which said inner anti-friction rollers are freely-rotating caged roller bearings, and the anti-friction rollers installed on said outer periphery are trunnioned roller bearings.

15. The non-contact vane-type fluid displacement machine as recited in claim 13, in which said anti-friction rollers are freely-rotating caged roller bearings.

16. The non-contact vane-type fluid displacement machine as recited in claims 13, in which said anti-friction rollers on said inner periphery and said outer periphery are trunnioned roller bearings.

17. The non-contact vane-type fluid displacement machine as recited in claim 1, in which said anti-friction rollers directly engage both the inner and the outer periphery of each tether, with freely-rotating caged roller bearings being utilized as the rollers on the outer periphery of each tether, and trunnioned bearings being utilized as the rollers on the inner periphery of each tether.

18. The non-contact vane-type fluid displacement machine in accordance with claim 1, wherein at least one of the peripheral surfaces of said annuli of said endplates is fitted with separate hardened precision races to accommodate the bearing loads exerted by said vane tethers.

19. The non-contact vane-type fluid displacement machine in accordance with claim 1, wherein a small distance is maintained between the inner peripheries of said vane tethers and the inner periphery of said annulus of said endplates, said small distance providing inward radial slack in the radial position of said vane in order to provide a purposeful leakage path between said vane tips and said conjugate internal conforming profile for said compressed fluid in the event of inadvertently high pressure development inside said machine.

20. The non-contact vane-type fluid displacement machine in accordance with claim 1, wherein the combination of said endplates, rotor, casing, vanes, and a seal region between said rotor periphery and conjugate internal conforming casing profile, comprise a gas compressor wherein chambers are formed within said casing, rotor periphery, two adjacent vanes, and endplates, and as said rotor rotates, said chambers undergo significant volume changes such that when said gas enters said machine through an inlet passage, said gas undergoes compression and is discharged through a discharge passage at elevated pressure.

21. The non-contact vane-type fluid displacement machine in accordance with claim 1, wherein the combination of said endplates, rotor, casing, a single vane, seal region between said rotor periphery and conjugate internal conforming casing profile comprise a fluid compressor or pump wherein a fluid chamber is formed within said casing, rotor periphery, said single vane, and seal region, and said endplates, and as said rotor rotates, said chamber undergoes volume change such that when fluid enters said machine through an inlet passage, said fluid undergoes pumping or compression and is discharged through a discharge passage at elevated pressure.

22. A non-contact vane-type fluid displacement machine comprising a casing having around its interior a conjugate internal conforming profile, said casing being arranged between two opposing endplates, each endplate containing in its interior a circular annulus, said annuli being of substantially matching configuration, each annulus having an inner and outer periphery, the center of each annulus being coincident with the geometric center of said conjugate internal conforming profile, a rotor supported by said endplates and mounted for rotation in said interior of said casing in a matching eccentric relationship with said conjugate internal conforming profile, said rotor having ends operationally disposed in a close fitting relationship with said opposing endplates, said rotor being equipped with four symmetrically rectangular vane, each vane having a circularly configured art tip which is maintained in an exceedingly close but non-contact relationship with said conjugate internal conforming profile, each end of each vane being equipped with a pivotally-mounted tether at a location comparatively remote from said vane tip, each said vane tether having inner and outer peripheries, roller bearings being located between at least the outer periphery of each of said endplate annuli and the outer periphery of each said vane tethers such that the outer periphery of each of said vane tethers directly engages the roller bearings, the inner periphery of said vane tethers engaging the inner periphery of each said annulus, the annulus in each of said endplates thus configured as an effective guide for the respective tethers of said vanes and for said roller bearings, and, therefore, the tips of said vanes, said vane tips thus being caused to remain in an exceedingly close yet substantially frictionless relationship with said conjugate internal conforming profile.

23. The non-contact vane-type fluid displacement machine in accordance with claim 22, wherein at least one of the peripheries of said annuli of said endplates is fitted with separate hardened precision races to accommodate the bearing loads exerted by the said vane tethers.

24. The non-contact vane-type fluid displacement machine in accordance with claim 22, wherein the periphery of said rotor is engaged sealingly with said stator casing at a region separating the zone of high pressure fluid from the zone of low pressure.

25. The non-contact vane-type fluid displacement machine in accordance with claim 22, wherein a small distance is maintained between the inner peripheries of said vane tethers and the inner periphery of said annuli of said endplates, said small distance providing inward radial slack in the radial position of said vane in order to provide a purposeful leakage path between said vane tips and said conjugate internal conforming casing profile for said compressed fluid in the event of inadvertently high pressure development inside said machine.

26. The non-contact vane-type fluid displacement machine in accordance with claim 22, wherein the combination of said endplates, rotor, casing, vanes, and seal region between said rotor periphery and the internal casing profile, comprise a gas compressor wherein gas chambers are formed within said casing, rotor periphery, two adjacent vanes, and opposing endplates, and as said rotor rotates, said chambers undergo significant volume changes such that when gas enters said machine through an inlet passage, said gas undergoes compression and is discharged through a discharge passage at elevated pressure.

* * * * *